United States Patent [19]

Platek et al.

[11] Patent Number: 4,515,672

[45] Date of Patent: May 7, 1985

[54] RETICULATE ELECTRODE AND CELL FOR RECOVERY OF METAL IONS

[75] Inventors: Gary F. Platek, Concord; Geoffrey P. Krug, Painesville, both of Ohio

[73] Assignee: Eltech systems Corporation, Boca Raton, Fla.

[21] Appl. No.: 516,867

[22] Filed: Jul. 25, 1983

Related U.S. Application Data

[63] Continuation-in-part of Ser. No. 319,480, Nov. 9, 1981, abandoned.

[51] Int. Cl.[3] ..... C25C 7/00; C25C 7/02; C25B 11/12; C25B 11/03

[52] U.S. Cl. ..... 204/269; 204/275; 204/284; 204/290 R; 204/294; 204/149; 204/292; 204/DIG. 13

[58] Field of Search ..... 204/290 R, 294, 11, 204/269–270, 149, 242, 282–284, 296, 106, 275, 292, DIG. 13

[56] References Cited

U.S. PATENT DOCUMENTS

| | | | |
|---|---|---|---|
| 3,549,505 | 12/1970 | Hanusa | 204/11 |
| 3,694,325 | 9/1972 | Katz et al. | 204/11 |
| 3,969,201 | 7/1976 | Oloman et al. | 204/222 X |
| 4,216,073 | 8/1980 | Goldstein | 204/296 X |
| 4,276,147 | 6/1981 | Edner et al. | 204/275 X |
| 4,292,160 | 9/1981 | Marcantonio | 204/294 X |
| 4,293,396 | 10/1981 | Allen et al. | 204/106 |
| 4,294,893 | 10/1981 | Iemmi et al. | 204/294 X |
| 4,299,682 | 11/1981 | Oda et al. | 204/284 X |
| 4,313,813 | 2/1982 | Johnson et al. | 204/294 X |
| 4,330,387 | 5/1982 | Astruc et al. | 204/284 X |
| 4,336,124 | 6/1982 | Gerard et al. | 204/284 |
| 4,350,580 | 9/1982 | Kadija | 204/279 |
| 4,370,214 | 1/1983 | Kadija | 204/284 X |
| 4,399,020 | 8/1983 | Branchick et al. | 204/269 |
| 4,430,176 | 2/1984 | Davison | 204/284 X |
| 4,445,990 | 5/1984 | Kim et al. | 204/294 X |

FOREIGN PATENT DOCUMENTS

| | | | |
|---|---|---|---|
| 128542 | 11/1978 | Japan | 204/11 |

*Primary Examiner*—Donald R. Valentine
*Attorney, Agent, or Firm*—John J. Freer

[57] ABSTRACT

A reticulate cathode, for use in an electrolytic cell for scavenging a metal from a solution containing ions of the metal, comprising an open cell electrically conductive foam which has been coated with conductive carbon particles. A cathode assembly comprises an electrically conductive support member to which the conductive foam is secured, the support also serving as the current conductor. The resistivity of the foam is less than 3000 ohm-cm, preferably in the range from about 40–1000 ohm-cm, and it has a pore size in the range from about 10 pores per inch (ppi) to about 100 ppi, and a void fraction in the range from about 0.5 to about 0.98. In its most preferred embodiment, the cathode is preplated with copper in an amount from about 0.5–20 g/ft$^2$ of active area, sufficient to impart rigidity to the cathde and avoid using a support member.

5 Claims, 3 Drawing Figures

RETICULATE ELECTRODE AND CELL FOR RECOVERY OF METAL IONS

This is a continuation-in-part of co-pending application Ser. No. 319,480 filed Nov. 9, 1981, now abandoned.

BACKGROUND OF THE INVENTION

The invention is directed to the recovery of metal ions by electrodeposition thereof from waste water streams such as those obtained in the metal finishing industry. By "metal" in this application, we refer particularly to electrodepositable ("platable") metals such as copper (Cu), zinc (Zn), cadmium (Cd), nickel (Ni) and precious metals such as silver (Ag) and gold (Au). The waste water streams typically contain one or more metals in a concentration less than about 1000 parts per million (ppm), often less than about 500 ppm. The lower the concentration of the metal in the stream the more difficult it is to recover the metal economically. Streams with concentrations less than about 1000 ppm have relatively few ions per unit volume and are generally referred to as 'dilute aqueous metal-bearing streams'; they will be referred to herein as "problem streams" because of the well-recognized problem of recovering their metal values economically.

This invention is especially directed to scavenging problem streams and reducing their concentrations to as low as about 0.5 ppm to about 10 ppm ("low end concentration") depending upon the flow volume, the residence time in the cell, and stream characteristics. Streams with greater concentrations in the range from about 1 gram per liter (g/l) to about 10 g/l are far more easily scavenged than the problem streams, and of course, our cathodes may be profitably used with such relatively metal-rich streams.

Statistically, if most of the relatively few ions (problem streams being dilute) are to find their way to a cathode surface, the cathode must be a high surface area electrode. By "high surface area" electrode we refer to a three-dimensional electrode in which the ratio of the active surface of the electrode to the geometric volume of the electrode is at least 150 and preferably from about 500 to about 2000. By "geometric volume" we refer to the product of the length l, the width w, and the thickness or height h, of a parallelepiped electrode. Thus its volume is lwh, and the geometric surface area of one face is lw. Such high surface area is provided by reticulated electrodes ("reticulates") such as are disclosed in copending commonly assigned U.S. patent application Ser. No. 286,551 (hereafter "the '551 application"), filed July 24, 1981, issued on Aug. 16, 1983, as U.S. Pat. No. 4,399,020 the disclosure of which is incorporated by reference thereto as if fully set forth herein.

Our invention is specifically concerned with directly metal-electroplated electrodes referred to herein as "single deposit electrodes" (for brevity, "SDE") because the electrode is plated with a single plating process, namely electroplating. These electrodes are made from an electrically conductive open cell foam ("ECOF" for brevity) referred to as "large pore" foam having a void fraction in the range from about 0.5 to about 0.98 and more preferably from about 0.75–0.98.

"Void fraction" and "porosity" are synonymous terms except that the former is expressed as an arithmetic fraction, and the latter is expressed as a percentage. The pores of an ECOF are easily visible, being in the range from about 0.15 mm to about 2 mm in equivalent diameter ("pore diameter"). Such pores are outlined in the foam by a mass of filaments (thin strands or ribbons) so as to produce a typical three-dimensional "filiform open cell foam morphology" referred to herein as a "foam reticulate", which is different from and clearly distinguishable over a woven fabric.

Essentially all the filaments of an ECOF are coated substantially uniformly with carbon particles which adhere to the filaments, and the pores are in open fluid communication with each other, and so remain after the ECOF is metal-plated, so as to afford through-passage for a metal-bearing aqueous solution ("solution porous") from one exterior surface of the reticulate to an opposite exterior surface. By "coated substantially uniformly" we mean that each unit of active area is coated with substantially the same weight of material (in this case, carbon). The ECOF is essentially identical with, and has essentially the same pore size, porosity or void fraction, and pressure drop characteristics as the uncoated electrically non-conductive foam ("ENCF") from which the ECOF was derived.

The desirability of "flow-through" electrodes is well-recognized (see for example the beds of conductive particles used in U.S. Pat. Nos. 3,696,201; 3,954,594; 3,977,951; 4,292,160; and, 4,313,813 inter alia), and numerous efforts have been made to provide such electrodes without adversely affecting the operating efficiency of the cell. Particle beds were used to provide the requisite area. A more recent development is of record in the aforementioned '551 application.

In our invention, as in the cell box described in the '551 application, plural alternating cathodes and anodes are connected to bus bars located on a non-conductive cell box, so that in operation, the cell scavenges metal contaminants by deposition thereof on the cathodes. A preferred anode is a dimensionally stable anode ("DSA ®") such as is described in U.S. Pat. Nos. 3,632,498; 3,711,385; 3,751,296, inter alia, the disclosures of which are incorporated by reference thereto as if fully set forth herein. Our cathode may be substituted for the cathode used in the prior art cell box.

The preferred cathode in the '551 application comprises an organic polymer (for example, polyurethane) open cell foam substrate having mostly interconnecting pores upon which substrate there is deposited electrolessly, then electrolytically, (hence referred to as a "dual deposit electrode" or "DDE" for brevity), a metal or alloy thereof. The drawback of this DDE is that it requires plural processing steps which are time-consuming, requires the use of much equipment, and uses too much raw material. The DDE is costly to fabricate.

Apart from and unrelated to the cost of a DDE, in other liquid permeable prior art cells, the use of a separator means ("separator") in the path of flow of the solution being scavenged, appeared to be an unavoidable necessity, particularly if particles are to be confined. By a "separator" we refer to a porous insulating sheet of plastic fiber cloth, polypropylene, and similar "small pore" materials having pores smaller than about 0.1 mm pore diameter, and include 'membranes'.

Many efforts have been made in the prior art to obviate the use of a separator of any kind because of its inherent relatively high resistance to flow which was exacerbated since it was so easily clogged in a scavenging service. For example, as early as in U.S. Pat. No. 2,616,165 an open mesh woven material, or a thin porous mat of fibers, was shown as having been coated with metal to make the mat conductive. The impracticality of coating a foam reticulate by such methods was overcome many years later with the advent of the DDE referred to hereinabove. U.S. Pat. No. 3,969,201 taught the use of a bed of graphite particles which bed was liquid permeable, but required confinement with a membrane; the concept of providing a non-conductive foam coated with carbon particles was never suggested.

A method for preparing a DDE is disclosed in "Characterization of Reticulate, Three-Dimensional Electrodes" by Tentorio, A. et al, *Jour. of Appl. Electrochem.*, 8 at 195–205, 1978. Though the SDE and DDE have comparable performance in service, the cost of fabricating a DDE is significantly higher than that of a SDE.

A desire to produce an SDE raises the problem of providing adequate conductivity for a foam reticulate and affects the choice and design of the current conductor for producing it. This is a serious problem even when the electrode is a battery plate having a skeleton of welded metallic fibers and one side of the plate is compressed in the form of a base on which strips of nickel are welded, as disclosed in U.S. Pat. No. 3,600,227.

Reverting therefore to the DDE, it was evident that a desirable goal was to deposit metal on the thin filaments or strands in a single operation, in enough concentration to give the requisite conductivity at minimum expense. This was the formula for an effective SDE. The problem was to reduce the formula to practice.

Initial attempts to fabricate an SDE failed partly because it was not known that if an ECOF could be obtained having a resistivity in the "right" range, the ECOF could be electrodeposited with a thin substantially uniform deposit of a platable metal if the ECOF was suitably supported over one face with a current conductor. Most commercially available ECOFs, whether organic carbon-coated ECOFs such as polyurethane, or a carbon-coated ENCF such as ceramic or glass foam, had resistivities in the range above about 3000 ohm-cm and could not be plated. Even a resistivity in the range from about 1000 ohm-cm to about 3000 ohm-cm was found generally to be too high to produce a thin substantially uniform deposit without (i) damaging the ECOF at the current density required to deposit metal, or, (ii) over-polarizing the cell, as is evidenced by an excessive energy consumption in the cell.

To counter this problem the prior art resorted to numerous structural configurations for their electrodes, as for example, the toothed electrodes bonded to the organic foam with a metal deposit, disclosed in U.S. Pat. No. 4,336,124.

The problem of low conductivity was found to be overcome when the ECOF was wrapped around a copper tube, except that it caused the ECOF to be weakly bonded to the surface of the tube. This was fortuitous from the point of view of improving heat transfer after pyrolysis of the ECOF, as disclosed in U.S. Pat. No. 4,136,428. It was of little use relative to electrowinning metals from problem streams as the electroplated foam on a tube surface was not liquid-permeable in a direction at right angle to its circumferential surface (either before or after pyrolysis of the foam). Moreover, electrodepositing copper from an air agitated standard copper sulfate electroplating solution was far-removed from scavenging metals from a problem stream. Nevertheless, the possibility that an ECOF containing carbon which was coated on the filaments of the foam (also referred to as graphite-coated ECOF) may be made sufficiently conductive within a preselected range, to allow directly electroplating the ECOF, in a single step, from a dilute metal-bearing solution, sparked the improvement of this invention over the reticulated cathode of the '551 application.

Reticulates having a void fraction in the range from about 0.5–0.8 (porosity of 50–80%) are sometimes referred to as "felt-like porous bodies"; and, those having a void fraction in the upper range from about 0.75–0.98 are referred to as "sponge metals". See "Characteristics and Applications of Sponge Metal" by Eiji Kamijo and Masaaki Honda, in *Chemical Economy and Engineering Review*, published by Chemical Economy Research Institute (Japan), December 1975, the disclosure of which is incorporated by reference thereto as if fully set forth herein. Though there is no enabling disclosure as to how such sponge metals may be prepared, their pores are said to have a spherical shape, and their sintered metal framework extends in all directions in a continuous reticulated structure, having high surface area well-suited for use as electrodes. Except that such sintered metal electrodes are not disposable or economical in scavenging problem streams.

The matter of cost of a cathode to be used in this "problem stream service" is critical since 'common' metals such as copper and zinc are not routinely recovered for reuse as the cost of doing so is economically unjustifiable. Such metals are electrowon for environmental considerations, not for their intrinsic value. Therefore, the 'loaded' or 'filled' cathodes are simply discarded as scrap. Hence this invention is more particularly directed to the production of disposable cathode reticulates having an ECOF substrate, and specifically to cathodes derived from and retaining a skeletal framework ("skeleton") of a synthetic resinous ECOF ("SRECOF") such as polyurethane. When the price of common metals justifies it, the filled cathodes may be used as anodes and the metals recovered; or the metals may be recovered by any other known process.

In light of the foregoing it will now be apparent that it has long been theoretically established that a sufficiently large number of essentially pure Cu, Ni, Cd, Zn, Ag or Au reticulates with sufficient area, alternated with anodes, will effectively scavenge a problem stream containing ions of one or more of the metals; but the cost of such pure metal cathodes relegates their use to academic studies.

SUMMARY OF THE INVENTION

It has been discovered that an electrically conductive open cell foam ("ECOF") containing conductive carbon particles which provide the ECOF with a resistivity less than about 3000 ohm-cm may be directly plated with a metal, because the ECOF functions as a cathode which is permeable to an aqueous solution ("solution porous") containing ions of the metal. Such a cathode serves as an economical reticulate cathode for electrowinning the metal from the solution.

It is therefore a general object of this invention to provide a solution porous conductive cathode assembly including (a) and ECOF having large pores outlined by filaments coated with carbon particles to provide a resistivity less than 3000 ohm-cm, and (b) an electrically conductive support member to which one surface of the ECOF is attached in electrically conductive contact over a major portion of that surface.

It has further been discovered that a cathode for scavenging ions of a metal selected from the group consisting of Cu, Ni, Cd, Zn, Ag and Au from a "problem stream" may be fabricated by directly electrodepositing a substantially uniform thin deposit of one of the metals on an ECOF containing conductive carbon or graphite (these terms are used interchangeably herein) particles coated substantially uniformly on filaments forming the foam which has a large pore filiform open cell morphology which allows the cathode to be permeable to an aqueous solution containing the metal ions.

It is therefore a general object of this invention to provide a solution-porous ECOF cathode coated with conductive carbon particles and plated with a substantially uniform thin deposit of metal, for use in an electrolytic cell with a suitable anode, in the recovery of ions of the same or another metal from a problem stream which is flowed through alternating anodes and cathodes in a cell box.

It has still further been discovered that an SRECOF having a large pore size, high porosity (high void fraction) and a resistivity in a predetermined range less than 3000 ohm-cm, may be substantially uniformly electroplated directly, with a thin deposit of a metal selected from the group consisting of Cu, Ni, Cd, Zn, Ag and Au so that the reticulate cathode so formed, in use, scavenges one or more of the metals by efficiently "filling" essentially all the pores of the cathode without preferentially "blinding" those at or close to the (cathode) surface nearest the anode.

It is therefore a specific object of this invention to produce a low cost, directly substantially uniformly copper-plated or nickel-plated cathode which is derived from an SRECOF containing conductive carbon particles and having a pore size in the range designated by 10 pores per inch (ppi) to about 100 ppi, a void fraction in the range from about 0.5 to about 0.98, and a resistivity in the range from about 40 ohm-cm to about 1000 ohm-cm.

BRIEF DESCRIPTION OF THE DRAWINGS

The foregoing and other objects and advantages of our invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

Figure 1:
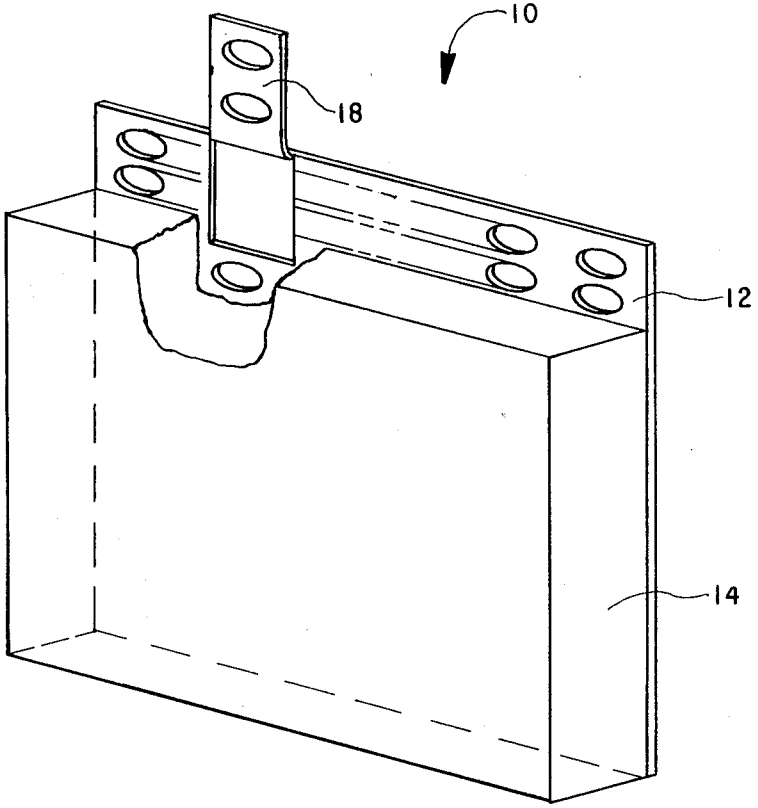
FIG. 1 is a perspective view schematically illustrating a first embodiment of a supported cathode assembly in which an archetype reticulate is supported on one face ("single-side cathode"), coextensively over the geometric surface of one face.

The cathode of this invention, in one embodiment, comprises in combination (a) an ECOF reticulate containing conductive carbon particles adherently held on the filaments or strands of the foam and having a resistivity less than 3000 ohm-cm ("requisite resistivity"); and, (b) a current-conducting support member in overlying contact with a major portion of one face of the ECOF. The conductive carbon particles impart conductivity to the ECOF in a predetermined preferred range of resistivity from about 40–1000 ohm-cm which range is peculiarly well-suited to electroplating the ECOF with Cu, Ni, Cd, Zn, Ag or Au at a current density which neither damages the ECOF nor overpolarizes the cell.

By "ECOF" we refer to any electrically conductive essentially filamentary material capable of being formed with the characteristic filiform open cell morphology with filaments which can be coated or impregnated with conductive carbon particles so as to provide the requisite resistivity. Such materials are preferably organic polymers, for example, polyurethane, certain polyolefins, particularly polypropylene, particular polyesters, nylons, poly(vinyl chloride), and the like.

Particularly preferred are the open cell polyurethane foams having from about 10 pores per inch (ppi) to about 100 ppi, the pores ranging from about 2 mm to about 0.15 mm in diameter, respectively, the smaller the pores, the more ppi. This designation of "ppi" is used herein because it is commonly used in the foam-producing industry. For the particular purpose of scavenging Cu, Ni, Cd, Zn, Ag and Au from problem streams, polyurethane foam having from 10–50 ppi, and an active area (specific surface area) from about 150–2000 $ft^2/ft^3$ of foam, is most preferred.

Certain electrically conductive inorganic materials may also be produced with an open cell morphology approximating that of an organic foam, particularly certain aluminas and related ceramic materials, and also some glass fiber battes, but coating these materials with carbon particles so as to obtain the requisite resistivity, is difficult. It is expected that any ECOF reticulate having the requisite resistivity because it is coated with carbon particles, may be substituted for the most preferred SRECOF, namely polyurethane, but not with the same facility.

Such a polyurethane SRECOF is produced in a known manner to impart predetermined resistivity. Such foams are available from the Foam Division of The Scott Paper Company; Lewcott Chemicals and Plastics; and Richards, Parents and Murray ("RPM"), inter alia, in a wide array of specifications. Preferred foams have a resistivity in the range from about 50–500 ohm-cm as measured by the measurement procedure set forth hereinbelow. Foams which are substantially less conductive (resistivity greater than 1000 ohm-cm) are not easily metal-plated, while those having lower resistivity than about 40 ohm-cm, are plated so quickly that the pores near the face of the reticulate cathode are blinded.

The shape of a reticulate cathode is generally a parallelepiped, the thickness of which, measured in the direction of flow of the stream, ranges most preferably from about 0.2" to about 0.5". The width and height of the cathode are arbitrary, being adapted for use in a cell box in which they are to be used.

It will be evident that the thinner the cathode, the more easily it will be plated. Thus, other than the inconvenience and expense of replacing the thin cathode, its thinness, is not critical. However, a cathode thickness in excess of 1" does not plate substantially uniformly. A non-uniformly plated cathode is not efficently "filled" or metal-laden substantially uniformly and tends to be blinded.

The current density at which copper plating is carried out is determined by several factors and is usually arrived at with a little trial and error such as one skilled in the art expects to undertake to establish desirable operating conditions for the bath. With typical problem streams containing from about 200 ppm to about 1000 ppm a current density in the range of from about 4 amps/geometric $ft^2$ to about 60 amp/$ft^2$ depending upon the thickness of the cathode, solution characteristics, and other plating parameters, is found suitable.

In a second embodiment of our invention, it is preferred to plate only so much metal as is necessary to impart a sufficiently high conductivity to the ECOF reticulate cathode so that its conductivity is substantially the same as that of the metal, in which case the design of a current conductor to the cathode is only a routine consideration. When copper is plated, the preferred amount substantially uniformly plated is in the range from about 0.5–20 g/$ft^2$ of active area. An amount in this range is found also to impart substantial rigidity to the plated SRECOF, such rigidity being desirable when the cathode is in use so that it does not "short" aginst the anode because no membrane separates the anode and cathode.

A ceramic ECOF is rigid to begin with, and pre-plating for the sake of rigidity is not a consideration. Before a SRECOF is plated, it is limp. When one-half of a 24"×24" sheet of 25 ppi polyurethane foam 0.25" thick is supported horizontally on a flat surface, the other half hangs downward nearly vertically. After the sheet is plated with 6 g/$ft^2$ it may be clamped by one edge to a supporting surface, and the sheet maintains its horizontal position with essentially no deflection, hence herein termed "rigid". A plurality of geometrically similar such reticulate cathodes are alternated with titanium mesh DSAs in an electroplating cell. Once the SRECOF is plated with copper it may also be used for plating out thereover Ni, Cd, Zn, Ag or Au. It will be appreciated that, though "filling" of pre-plated reticulate cathode is thus not continuous, the entire plating of the SRECOF is only electrodeposited, that is, plated with a single process.

Referring particularly to FIG. 1, there is shown an unplated ECOF reticulate cathode 14 having length l, width w and thickness h attached to a generally laminar current conducting, supporting means ("support") 12 having a multiplicity of apertures 15 which permits through-passage of an aqueous solution to be scavenged. There is no more resistance to flow of liquid (pressure drop) through the support 12 than there is through the reticulate cathode 14, which is negligible when the cathode is first placed in service.

By negligible resistance to flow of liquid we refer to the fact that pressure drop through a foam is generally measured in 'inches of water' for a stream of air flowing at relatively high velocity in the range from about 200 feet per minute (fpm) to about 800 fpm, and this pressure drop for foams in the range from about 10 ppi to about 100 ppi, ranges from about 0.1 in of $H_2O$ to about 5 ins of $H_2O$ depending upon the flow rate and pore size. No corresponding pressure drop is measured at normal liquid flow rates in an electrolytic cell, when the cathodes commence service.

The support 12 is preferably sufficiently rigid to withstand deflection during operation due to pressure exerted by the solution flowing through it. A perforated plate (shown), metal mesh, or, a woven grid whether of metal wire or conductive synthetic resinous material, are all effective, though unequally so, and not at equal cost. The support 12 thus serves both as current conductor and as structural member to position and support the reticulate. To provide an adequate current conduction means, the support is in contact and coextensive with one surface of the cathode over a major portion of its geometric surface, that is, greater than ½lw. For best results, the support 12 overlies the entire surface of one face of the reticulate cathode. A connector tab 18 is provided, protruding upward to afford a convenient connection for current.

As stated hereinbefore, the SRECOF reticulate is most preferably derived from a polyurethane foam, though a non-woven batte with a comparable open cell morphology may be used. It will be evident that an adequately designed bank of cells in a cell box will permit flow through them of the stream to be scavenged, without accumulation of liquid within the cell box. It will also be evident that as the reticulate is progressively more metal-laden with scavenged metal, flow of the solution will be impeded until accumulation builds flow over the upper edge of the cathode.

As illustrated, the reticulate cathode 14 has a thickness 0.25", a width 18" and a length 14.19", so that its volume is 63.9 $in^3$. A reticulate of 25 ppi polyurethane having a volume of 63.9 $ft^3$ has an active surface area of about 425 $ft^2$.

It is most preferred to control the electrodeposition of copper on the polyurethane foam prior to placing a reticulate cathode in service. When copper-plated as specified hereinabove, the reticulate cathode is efficiently filled in service, typically being metal-laden with from about 50 lb to about 150 lb of copper per $ft^3$ (lb/$ft^3$) of reticulate, depending upon its pore size, porosity and thickness.

Figure 2:
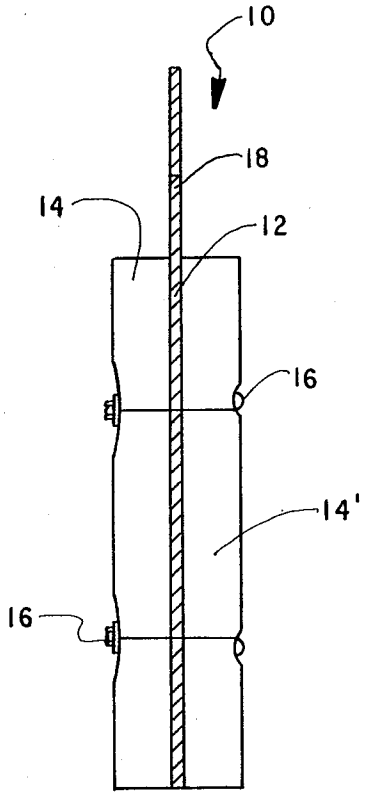
FIG. 2 is a vertical cross sectional view of a second embodiment schematically illustrating a supported cathode assembly comprising a pair of archetype organic foam parallelepipeds sandwiching a foraminous current-conducting support.

Referring to FIG. 2 there is schematically illustrated a side elevational cross-sectional view of a second embodiment of a cathode assembly indicated generally by reference numeral 20, including a support means 13 sandwiched between reticulates 14' and 14", and affixed thereto by staples, pins or other fastening means 16. When placed in service, the cathode assembly is positioned intermediate an anode 26 and support 12, as seen in FIG. 3.

Figure 3:
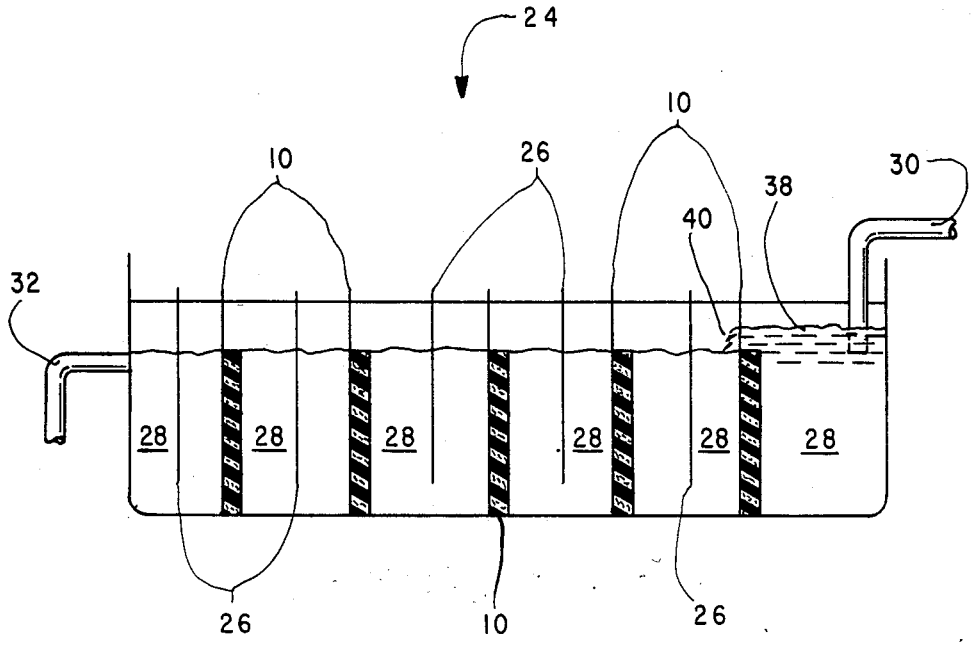
FIG. 3 is a cross sectional view diagrammatically illustrating a typical cell box in which a plurality of cathode assemblies such as shown in FIG. 1 are alternated with DSAs to scavenge a problem stream flowing therethrough.

Referring further to FIG. 3 there is diagrammatically illustrated a typical electroplating "scavenging" cell indicated generally by reference numeral 24 comprising plural cathode assemblies 10, 10' and plural DSAs 26 in alternating spaced-apart relationship within a cell box 25. The cathode assemblies divide the cell into compartments 28 within each of which a DSA 26 is operatively disposed. The aqueous solution containing metal ions to be scavenged enters the cell 24 through fluid inlet means 30 into a first compartment 28', and the scavenged solution leaves through outlet means 32.

When the cathode assembly 10' is eventually sufficiently metal-laden to impede flow, accumulated solution overflows through a zone 40 of the support 12, above the upper edge of the reticulate cathode 14, thus giving an immediate visual indication that the filled cathode assembly is to be replaced with a fresh one.

As illustrated (but not to scale), a distance of from about 0.25" to about 0.5" separates the surface of an anode from that of an adjacent cathode reticulate, and no membrane is required.

Though a support 12 is illustrated, it is not essential, since the plated reticulate cathode may be held in position in a suitably grooved cell box without additional support. The conductivity of the reticulate cathode plated with from about 2 g to about 10 g of copper per $ft^2$ of active area is such that the plated reticulate's conductivity is substantially the same as that of copper, as a result of which a pair of alligator clips, one at each oppositely disposed upper corner of the cathode, provides adequate electrical contact for necessary current. Such a reticulate cathode is visually indistinguishable from the archetype reticulate except of course, that one looks like copper and the other does not.

MEASUREMENT OF CONDUCTIVITY OF CARBON-COATED FOAM

The conductivity of a conductive foam, made conductive because of carbon particles adherently coating is substantially uniformly, is conveniently determined as 'resistivity' in the units 'ohm/cm'.

Two volt/ohm meters capable of measuring to 25 volts and 5 milliamps; one 1 ohm resistor (±1%); one 25 V/15 A power supply; two 1"×1"×0.5" copper electrodes; and miscellaneous wiring for making connections provide the essential equipment for making the measurement.

A piece of Scott ECOF 6"×8" is measured for its thickness. The copper electrodes are centered on the 6" edges so that they are perpendicular to the edge and are 6" from each other, edge-to-edge, and 7" center-to-center. The current is then started and the foam is compressed by applying sufficient force on the copper electrodes to compress the foam and obtain a stable reading on both meters. The resistivity is then determined as ohm-cm.

In a specific example, a 6"×8" piece of 7 ppi Scott carbonized foam, 0.75" thick, passed a current of 85.1 mA at 21.3 V.

Resistivity is computed as $R/L \times$ $$\text{thickness} \times \text{edge length of an electrode} =$$

$$(250.6\ \text{ohm}/7'' \times 2.54\ \text{cm/in}) \times$$

$$0.75'' \times 1'' \times 6.45\ \text{cm}^2/\text{in}^2 = 68.2\ \text{ohm-cm}.$$

EXAMPLE I

An open-topped electrolytic cell measuring approximately 6"×8"×8" in height fabricated from Lucite® polymethylmethacrylate was provided with a fluid inlet and outlet. Two approximately 6"×6"×0.375" thick squares of RPM #202 conductive polyurethane foam having a resistivity in the range from about 50–100 ohm-cm were secured along three edges with a non-conductive three-sided channel frame. A strip of aluminum foil was pressed into the unchanneled edge to provide electrical contact. The geometric area of a square which was effective to scavenge metal ions was about 5"×5".

The squares were placed for operation in the cell box with the aluminum strip topmost, and three expanded titanium mesh anodes were placed in the cell box so that the anodes were alternated with cathodes, about 0.5" apart. The anodes measured about 5"×5" and were coated with a mixture of tantalum, titanium and iridium oxides. A current feeder was connected to the aluminum foil strip so the foam square was made cathodic by connection to a current source.

15 l (liters) of a $CuSO_4$ solution in dilute $H_2SO_4$ acid having a pH of about 1.5 and containing about 250 ppm copper, were recirculated through the cell while a current of 5 amps/$ft^2$ of foam (based on the effective geometric area) was passed between the anodes and cathodes. The rate of circulation was 3 gals/min/$ft^2$ of geometric cathode area.

After an hour the concentration of copper in the recirculating solution was 73 ppm. Voltage between anodes and cathodes during this period declined from about 3.8 volts to about 2.4 volts.

EXAMPLE II

A cathode assembly was fabricated by sandwiching a 6"×6"×8" piece of aluminum structural mesh having greater than 50% open area, between two squares of RPM #202 polyurethane conductive foam, each square being 6"×6". The squares were secured to the mesh with staples, and as in example I hereinabove, an aluminum current conductor was crimped to the top edges of the squares.

The cathode assembly was placed between a pair of DSA® anodes, with 0.5" spacing, in a cell box, in a manner analogous to that described in example I, and 15 l of a $CuSO_4$ solution having a pH of 1.75 and containing 210 ppm copper, was circulated through the cell at 6 gals/min/$ft^2$ of cathode surface.

After an hour the copper content of the circulating solution was reduced to 100 ppm. Voltage between anode and cathode declined from an initial 2.5 colts to a final 2.3 volts.

EXAMPLE III

A cathode assembly was fabricated by sandwiching a piece of the aluminum mesh about 18"×15" between two pieces of conductive polyurethane foam coated with carbon particles, the foam obtained from Lewcott Chemical, each piece of foam being 18"×15"×0.125" thick. The foam was adhesively secured to the mesh with a conductive epoxy resin. The cathode assembly was used in a cell with TIR-2000 DSA® anodes spaced apart about 0.5" apart, as before.

A waste water stream containing about 150 ppm copper was passed through the cell with no recycle for about 200 hr at 2 gals/min/$ft^2$ of exposed cathode area. A direct current of 3 amps/$ft^2$ was applied at 2.8 volts. When flow was stopped 300 g of copper were deposited on the cathode.

EXAMPLE IV

An electrolytic cell containing an alternating series of 38 dimensionally stable DSA anodes and 37 reticulate cathodes of polyurethane foam plated with copper in an amount about 6 g/$ft^2$ of active area, is placed in service to treat an acid copper rinse water. The rinse water had the following characteristics: flow rate, 2 gal/min; copper concentration, 170 to 190 ppm; and pH range 3.0–4.0. The stream was treated in a single-pass mode with 3.1 amps delivered to each cathode in the cell. Cell voltage under these conditions averaged 2.41 volts. The outlet stream copper concentration ranged from 15 to 25 ppm. Average copper concentration within the cell box varied with the cathode number, but the average metal removal efficiency was 90 percent with the average current efficiency of 55 percent. DC energy consumption was 1.8 kilowatt hours per pound of copper removed. The average uptake for each reticulate cathode was 1.0 lb of copper over a 200-hr lifetime.

We claim:

1. In an electrolytic cell having no separator between an anode and cathode of a cell pair for removal of a metal ion contained in a waste water stream comprising, a non-conductive cell box including inlet and outlet means to introduce said stream into said cell box and lead it away therefrom, respectively;

plural anodes and alternating reticulate cathodes in spaced-apart relationship removably disposed in said cell box normal to the direction of flow of said solution, and bus bars disposed horizontally above said anodes and cathodes; the improvement comprising, each said reticulate cathode formed by electroplating an electrically conductive open cell foam having a resistivity in the range from about 40 ohm-cm to about 1000 ohm-cm with a single deposit of metal in an amount sufficient to render said foam substantially as conductive as said metal, and to produce a relatively rigid reticulate through which said waste water stream initially flows with substantially negligible resistance so as to deposit said metal on said cathode.

2. The electrolytic cell of claim 1 wherein said reticulate cathode is formed by electroplating an open cell polyurethane foam, having from about 10 pores per inch (ppi) to about 100 ppi and a resistivity in the range from about 50–500 ohm-cm, with a deposit of said metal selected from the group consisting of copper, nickel, cadmium, zinc, silver and gold in an amount in the range from about 0.5 $gm/ft^2$ to about 20 $g/ft^2$ of active area of said foam.

3. The electrolytic cell of claim 2 wherein said metal is copper.

4. In a solution porous conductive cathode for use in recovering metals from solutions of metal ions passing through the cathode, the improvement comprising: a solution porous conductive copper plated cathode containing conductive carbon particles.

5. In a solution porous conductive cathode for use in recovering metals from solutions of metal ions passing through the cathode, the improvement comprising: a solution porous conductive copper plated polyurethane cathode containing conductive carbon particles.

* * * * *